US008259138B2

(12) United States Patent
Yamada

(10) Patent No.: US 8,259,138 B2
(45) Date of Patent: Sep. 4, 2012

(54) IMAGE DISPLAY METHOD AND IMAGE DISPLAY DEVICE

(75) Inventor: Kazuhiro Yamada, Osaka (JP)

(73) Assignee: Panasonic Corporation, Osaka (JP)

( * ) Notice: Subject to any disclaimer, the term of this patent is extended or adjusted under 35 U.S.C. 154(b) by 848 days.

(21) Appl. No.: 11/568,534

(22) PCT Filed: Oct. 14, 2005

(86) PCT No.: PCT/JP2005/018932

§ 371 (c)(1),
(2), (4) Date: Oct. 31, 2006

(87) PCT Pub. No.: WO2006/041151

PCT Pub. Date: Apr. 20, 2006

(65) Prior Publication Data

US 2007/0165051 A1 Jul. 19, 2007

(30) Foreign Application Priority Data

Oct. 15, 2004 (JP) ..... 2004-301175

(51) Int. Cl.
*G09G 5/10* (2006.01)
*G09G 3/36* (2006.01)

(52) U.S. Cl. ..... 345/690; 345/89

(58) Field of Classification Search ..... 345/690, 345/89

See application file for complete search history.

(56) References Cited

U.S. PATENT DOCUMENTS 6,912,000 B1 * 6/2005 Shigeta ..... 348/222.1
7,071,902 B1 7/2006 Kawahara

FOREIGN PATENT DOCUMENTS

| | | | |
|---|---|---|---|
| JP | 10-31455 A | | 2/1998 |
| JP | 11-85101 A | | 3/1999 |
| JP | 11-212517 | * | 6/1999 |
| JP | 11-212517 A | | 8/1999 |
| JP | 2000-98959 A | | 4/2000 |
| JP | 2001-34229 A | | 2/2001 |
| JP | 2001-034229 | * | 8/2001 |
| JP | 2003-069922 A | | 3/2003 |
| KR | 2001-0052785 | | 6/2001 |

OTHER PUBLICATIONS

International Search Report for corresponding PCT International Application No. PCT/JP2005/018932 dated Jan. 24, 2006.
South Korea Office Action for 519980652221, Oct. 11, 2010.

* cited by examiner

*Primary Examiner* — Amr Awad
*Assistant Examiner* — Jonathan Boyd
(74) *Attorney, Agent, or Firm* — RatnerPrestia

(57) ABSTRACT

An image display method and an image display device in which one field is constructed by plural subfields weighted in brightness, and coding for controlling light emission and light non-emission of a pixel every each subfield is performed to display gradation, and coding with respect to a pixel of a dynamic image area and coding with respect to a pixel of a static image area are different; wherein a transition area is arranged between the dynamic image area and the static image area; and pixel A coded with respect to the pixel of the dynamic image area and pixel B coded with respect to the pixel of the static image area mixedly exist in the transition area.

8 Claims, 10 Drawing Sheets

FIG. 6

| | | Random number | | | |
|---|---|---|---|---|---|
| | | 0 | 1 | 2 | 3 |
| Transition area | 15 | 1 | 1 | 1 | 1 |
| | 7 | 0 | 1 | 1 | 1 |
| | 3 | 0 | 1 | 1 | 0 |
| | 1 | 1 | 0 | 0 | 0 |
| | 0 | 0 | 0 | 0 | 0 |

FIG. 8A

| Horizontal LSB signal / Horizontal counter output | 0 | 1 | 2 | 3 | 4 | 5 | 6 | 7 | 8 | 9 | ··· |
|---|---|---|---|---|---|---|---|---|---|---|---|
| Vertical LSB signal | 0 | 1 | 0 | 1 | 0 | 1 | 0 | 1 | 0 | 1 | ··· |

| Vertical counter output | Vertical LSB signal | | | | | | | | | | |
|---|---|---|---|---|---|---|---|---|---|---|---|
| 0 | 0 | 2 | 1 | 2 | 1 | 2 | 1 | 2 | 1 | 2 | 1 |
| 1 | 1 | 0 | 3 | 0 | 3 | 0 | 3 | 0 | 3 | 0 | 3 |
| 2 | 0 | 2 | 1 | 2 | 1 | 2 | 1 | 2 | 1 | 2 | 1 |
| 3 | 1 | 0 | 3 | 0 | 3 | 0 | 3 | 0 | 3 | 0 | 3 |
| 4 | 0 | 2 | 1 | 2 | 1 | 2 | 1 | 2 | 1 | 2 | 1 |
| 5 | 1 | 0 | 3 | 0 | 3 | 0 | 3 | 0 | 3 | 0 | 3 |
| 6 | 0 | 2 | 1 | 2 | 1 | 2 | 1 | 2 | 1 | 2 | 1 |
| 7 | 1 | 0 | 3 | 0 | 3 | 0 | 3 | 0 | 3 | 0 | 3 |
| 8 | 0 | 2 | 1 | 2 | 1 | 2 | 1 | 2 | 1 | 2 | 1 |
| 9 | 1 | 0 | 3 | 0 | 3 | 0 | 3 | 0 | 3 | 0 | 3 |
| : | : | | | | | | | | | | |

FIG. 8B

| | | Dither element | | | |
|---|---|---|---|---|---|
| | | 0 | 1 | 2 | 3 |
| Transition area | 15 | 1 | 1 | 1 | 1 |
| | 7 | 0 | 1 | 1 | 1 |
| | 3 | 0 | 0 | 1 | 1 |
| | 1 | 0 | 0 | 0 | 1 |
| | 0 | 0 | 0 | 0 | 0 |

FIG. 10 PRIOR ART

| Subfield | | 1 | 2 | 3 | 4 | 5 | 6 | 7 | 8 |
|---|---|---|---|---|---|---|---|---|---|
| Brightness weight | | 1 | 2 | 4 | 8 | 16 | 32 | 64 | 128 |
| Gradation difficult to generate dynamic image false contour | 0 | | | | | | | | |
| | 1 | • | | | | | | | |
| | 3 | • | • | | | | | | |
| | 7 | • | • | • | | | | | |
| | 15 | • | • | • | • | | | | |
| | 31 | • | • | • | • | • | | | |
| | 63 | • | • | • | • | • | • | | |
| | 127 | • | • | • | • | • | • | • | |
| | 255 | • | • | • | • | • | • | • | • |

FIG. 11 PRIOR ART
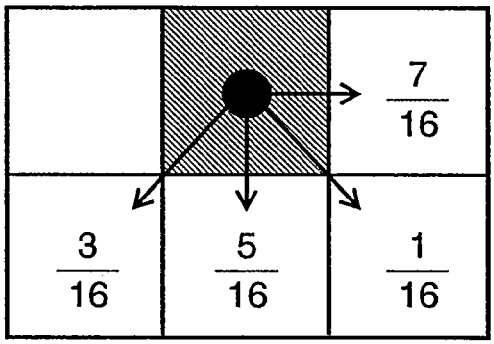

IMAGE DISPLAY METHOD AND IMAGE DISPLAY DEVICE

THIS APPLICATION IS A U.S. NATIONAL PHASE APPLICATION OF PCT INTERNATIONAL APPLICATION NO. PCT/JP2005/018932 FILED Oct. 14, 2005.

TECHNICAL FIELD

The present invention relates to an image display method and an image display device in which one field is constructed by plural subfields weighted in brightness, and gradation is displayed by performing coding for controlling light emission and light non-emission of a pixel every each subfield.

BACKGROUND ART

A so-called subfield method is known as a method for displaying a multiple gradation image by using a display device for performing binary display of a plasma display panel, etc. The subfield method is a method in which one field of an image signal is constructed by plural subfields weighted by brightness, and gradation is displayed by performing coding for controlling light emission or light non-emission of a pixel of each subfield.

For example, one field of the image signal is divided into eight subfields, and the brightness weights of the respective subfields are set to "1", "2", "4", "8", "16", "32", "64" and "128". The image signal is then set to a digital signal of eight bits, and this digital signal is sequentially allocated to the eight subfields from a least significant bit, and turning-on and turning-off control is performed so that images of 256 gradations can be displayed. However, when a dynamic image is displayed by the above display method, it is known that a great gradation disturbance of a contour shape, a so-called dynamic image false contour is generated in an area in which there is a movement within the image (hereinafter abbreviated as a "dynamic image area").

Therefore, as one method for generating no dynamic image false contour, it is tried that the movement of the image is detected and the display method of a gradation value, i.e., a coding method is changed in accordance with the existence of the movement of the image. In this trial, for example, in an area having no movement of the image (hereinafter abbreviated as a "static image area"), the gradation values display the 256 gradations from "0" to "255" in the above method, and the display is performed in the dynamic image area by limiting the gradation values to gradation values difficult to generate the dynamic image false contour. The dynamic image false contour in the dynamic image area can be reduced by such a display method. Further, the gradations of 256 combinations can be displayed in the static image area.

In the case of gradation values at which the subfield turned on in a direction sequentially increased from a minimum subfield in brightness weight is continued, the gradation values difficult to generate the dynamic image false contour are nine gradation values of "0", "1", "3", "7", "15", "31", "63", "127" and "255".

FIG. 10 shows the nine gradation values difficult to generate the dynamic image false contour. Here, a "circular mark" shows the subfield turned on with respect to each gradation value. The generation of the dynamic image false contour can be restrained by limiting the gradation values to only these nine gradation values and displaying an image of the dynamic image area by using these gradation values. However, in this case, the number of gradations able to be displayed is only nine. Therefore, image display quality is extremely reduced in this case. Therefore, gradation is corrected by using a so-called error diffusing method in which the difference between the gradation value to be displayed and the gradation value actually displayed is diffused to circumferential pixels by an appropriate ratio.

FIG. 11 is an explanatory view of the error diffusing method in the prior art. In the pixels shown by hatching and a white circle of FIG. 11, an error generated between the gradation value to be displayed and the gradation value actually displayed is respectively divided into a pixel adjacent on the right-hand side, a rightward downward pixel, a pixel just below, and a leftward downward pixel in a ratio of 7:1:5:3, and is added. In each pixel, a value provided by adding the gradation value to be displayed and the diffused error is set to a gradation value to be newly displayed, and a gradation value closest to this gradation value to be newly displayed is selected from the above nine gradation values, and is set to the gradation value actually displayed. Thus, the error between the gradation value to be displayed and the gradation value actually displayed is diffused to the circumferential pixels. This processing is repeatedly performed so that the gradation values except for the above nine gradation values can be artificially displayed by using the nine gradation values.

FIG. 12 is a circuit block diagram of a conventional image display device. The conventional image display device has movement detecting section 102 for detecting the dynamic image area from an input image signal, and also has adding section 106 for adding an error diffused from a circumferential pixel to the input signal. The conventional image display device also has static image coding section 107 for performing coding with respect to a pixel of the static image area with respect to an image signal provided by adding the error, and also has dynamic image coding section 108 for performing coding with respect to a pixel of the dynamic image area with respect to the image signal provided by adding the error. The conventional image display device also has selector 109 for selecting one of outputs of static image coding section 107 and dynamic image coding section 108 in accordance with an output of movement detecting section 102, and also has subtracting section 110 for calculating the error between an input image and an output image. The conventional image display device also has multiplying section 111 for performing predetermined weighting with respect to the error, and also has delay section 112 for adjusting timing to diffuse the error to a predetermined pixel. The conventional image display device further has display section 113 for displaying the image signal. The conventional image display device executes the above error diffusing operation.

However, in such a conventional method, the coding method is switched at the boundary of the dynamic image area and the static image area. Therefore, there is a case in which a noise of a sharp edge shape (hereinafter called a "switching shock") is generated at this boundary in accordance with an image. In particular, this switching shock is easily generated with respect to an image in which an object is moved with an area flat in brightness as a background.

In contrast to this, Japanese Patent Unexamined Publication No. 2003-69922 proposes a method for reducing the switching shock by diffusing a boundary portion by a random number and setting edges not to be uniformed. However, in the method described in this laid-open patent publication, the boundary of the dynamic image area and the static image area is merely diffused by using the random number. Accordingly, the boundary of the dynamic image area and the static image area is still left in the sharp edge shape, and no switching shock is perfectly vanished.

DISCLOSURE OF THE INVENTION

The image display method of the present invention is an image display method in which one field is constructed by plural subfields weighted in brightness, and coding for controlling light emission and light non-emission of a pixel every each subfield is performed to display gradation, and coding with respect to a pixel of a dynamic image area and coding with respect to a pixel of a static image area are different;

wherein a transition area is arranged between the dynamic image area and the static image area; and the pixel coded with respect to the pixel of the dynamic image area and the pixel coded with respect to the pixel of the static image area mixedly exist in the transition area.

Further, the image display device of the present invention is an image display device in which one field is constructed by plural subfields weighted in brightness, and coding for controlling light emission and light non-emission of a pixel every each subfield is performed to display gradation, and coding with respect to a pixel of a dynamic image area and coding with respect to a pixel of a static image area are different;

the image display device having:

a movement detecting section for detecting the dynamic image area;

a transition area making section for making a transition area between the dynamic image area and the static image area except for this dynamic image area;

a dynamic image coding section for performing coding with respect to the pixel of the dynamic image area;

a static image coding section for performing coding with respect to the pixel of the static image area; and a selecting section for selecting one of an output of the dynamic image coding section and an output of the static image coding section. The selecting section selects the output of the dynamic image coding section in the dynamic image area, and selects the output of the static image coding section in the static image area, and makes the selection such that the output of the dynamic image coding section and the output of the static image coding section mixedly exist in the transition area.

BRIEF DESCRIPTION OF THE DRAWINGS

FIG. 6 is a view showing one example of a conversion table of the image display device of embodiment mode 1 of the present invention.

FIG. 8A is a chart for explaining the operation of a selecting signal generating section of the image display device in embodiment mode 2 of the present invention, and setting a dither element from a horizontal LSB signal and a vertical LSB signal.

FIG. 8B is a chart for explaining the operation of the selecting signal generating section of the image display device in embodiment mode 2 of the present invention, and setting a selecting signal from the dither element of FIG. 8A and an output value of transition area making section 200.

FIG. 10 is a view showing nine gradation values difficult to generate a dynamic image false contour.

FIG. 11 is an explanatory view of an error diffusing method in a conventional image display device.

DESCRIPTION OF THE REFERENCE NUMERALS AND SIGNS

Figure 1A:
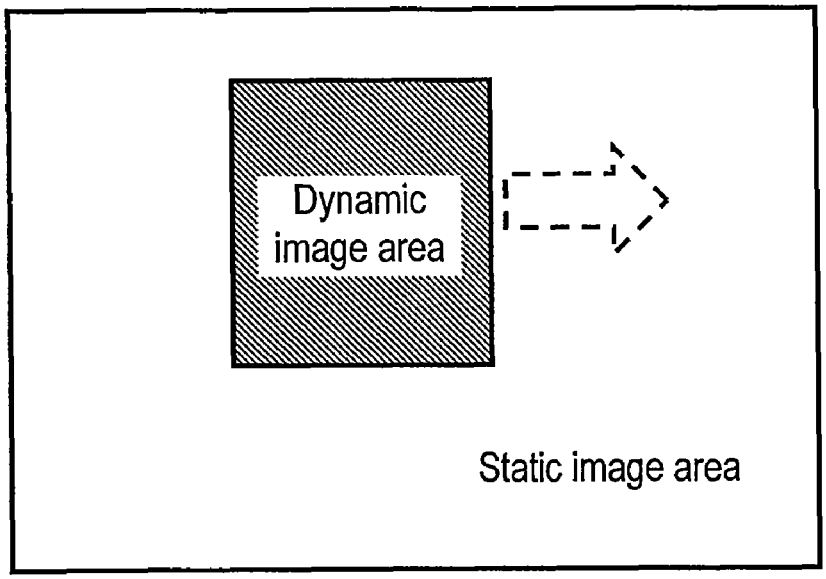
FIG. 1A is a view for explaining a method for restraining a switching shock in an image display device of embodiment mode 1 of the present invention.

102 movement detecting section
106 adding section
107 static image coding section
108 dynamic image coding section
109 selector
110 subtracting section
111 multiplying section
112 delay section
113 display section
200 transition area making section
310 random number generating section
300, 400 selecting section
305, 405 selecting signal generating section
201 low-pass filter circuit
202, 203, 204, 205 comparator
411 horizontal counter
412 vertical counter

BEST MODE FOR CARRYING OUT THE INVENTION

Embodiment Mode 1

Figure 1B:
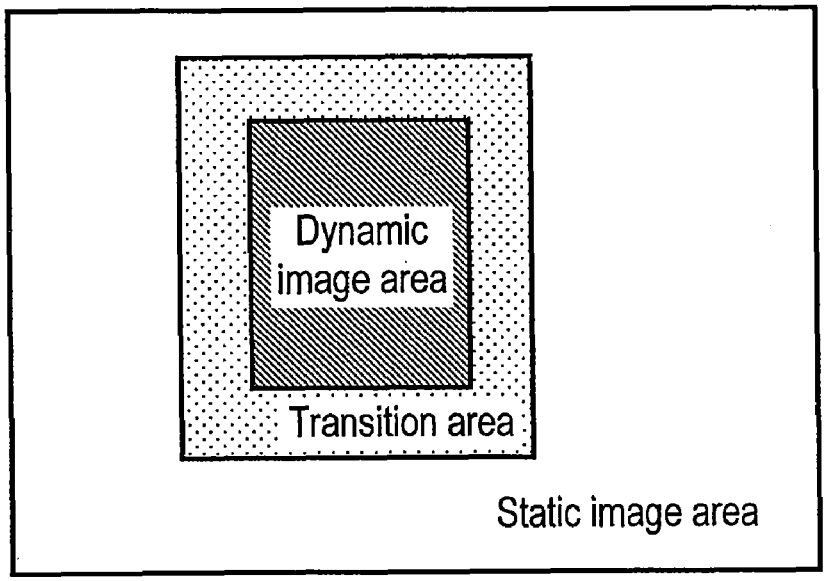
FIG. 1B is a view for explaining the method for restraining the switching shock in the image display device of embodiment mode 1 of the present invention.

FIGS. 1A and 1B are views for explaining a method for restraining a switching shock in an image display device of embodiment mode 1 of the present invention. As shown in FIG. 1A, for example, it is supposed that a square dynamic image area is detected within a display image. In embodiment mode 1 of the present invention, as shown in FIG. 1B, a transition area mixedly having a pixel processed as the dynamic image area and a pixel processed as a static image area is arranged between the dynamic image area and the static image area. Image signal processing is performed with respect to each pixel within the transition area such that the ratio of the pixel processed as the dynamic image area (hereinafter abbreviated as "pixel A") becomes high in an area close to the dynamic image area within the transition area, and the ratio of the pixel processed as the static image area (hereinafter abbreviated as "pixel B") becomes high in an area close to the static image area.

Figure 2:
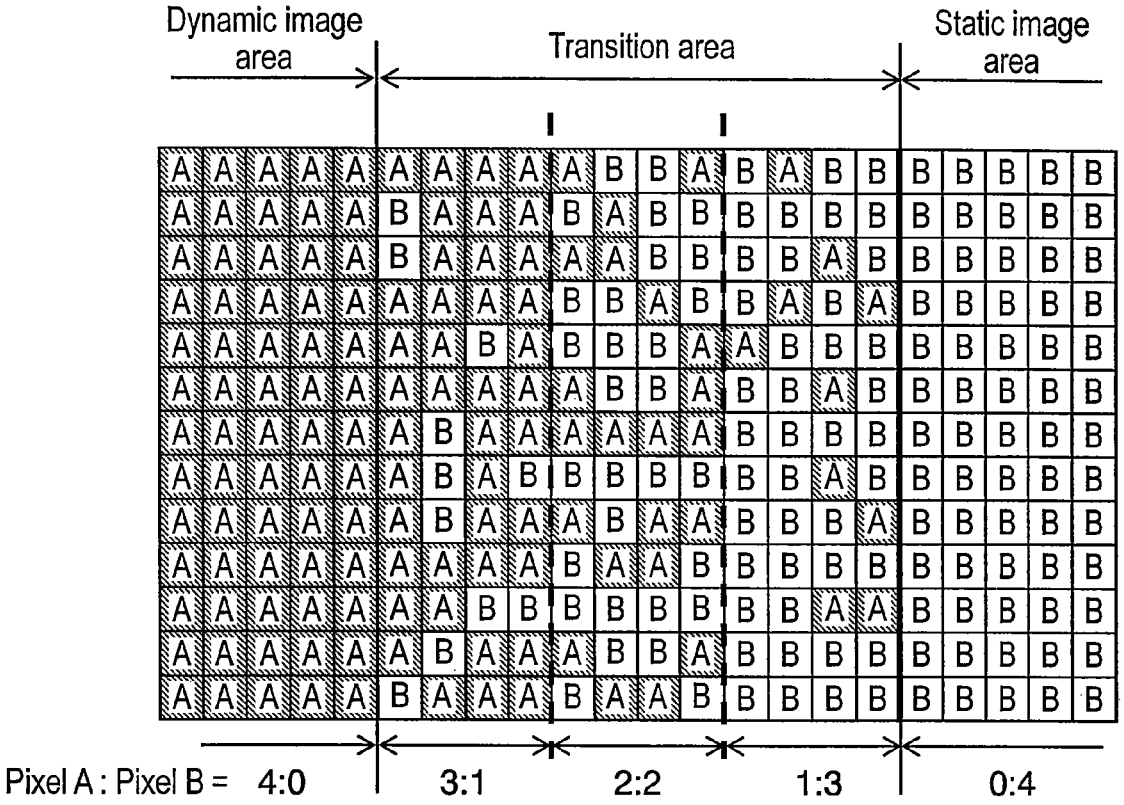
FIG. 2 is an image view showing a situation in which pixels A and B mixedly exist in a transition area in the image display device of embodiment mode 1 of the present invention.

FIG. 2 is an image view showing a situation in which pixels A and B mixedly exist in the transition area. Character "A" of this figure shows pixel A, and character "B" shows pixel B. Five columns of the left-hand end of FIG. 2 show pixels belonging to the dynamic image area, and five columns of the right-hand end show pixels belonging to the static image area. Twelve columns therebetween show pixels belonging to the transition area. In four columns of the left-hand end of the transition area, pixels A and B mixedly exist in a ratio of 3:1. In central four columns, pixels A and B mixedly exist in a ratio of 2:2. In four columns of the right-hand end, pixels A and B mixedly exist in a ratio of 1:3.

Thus, a switching shock can be restrained by gradually changing the mixedly existing ratio of the dynamic image area and the static image area, and smoothly connecting the dynamic image area and the static image area.

Figure 3:
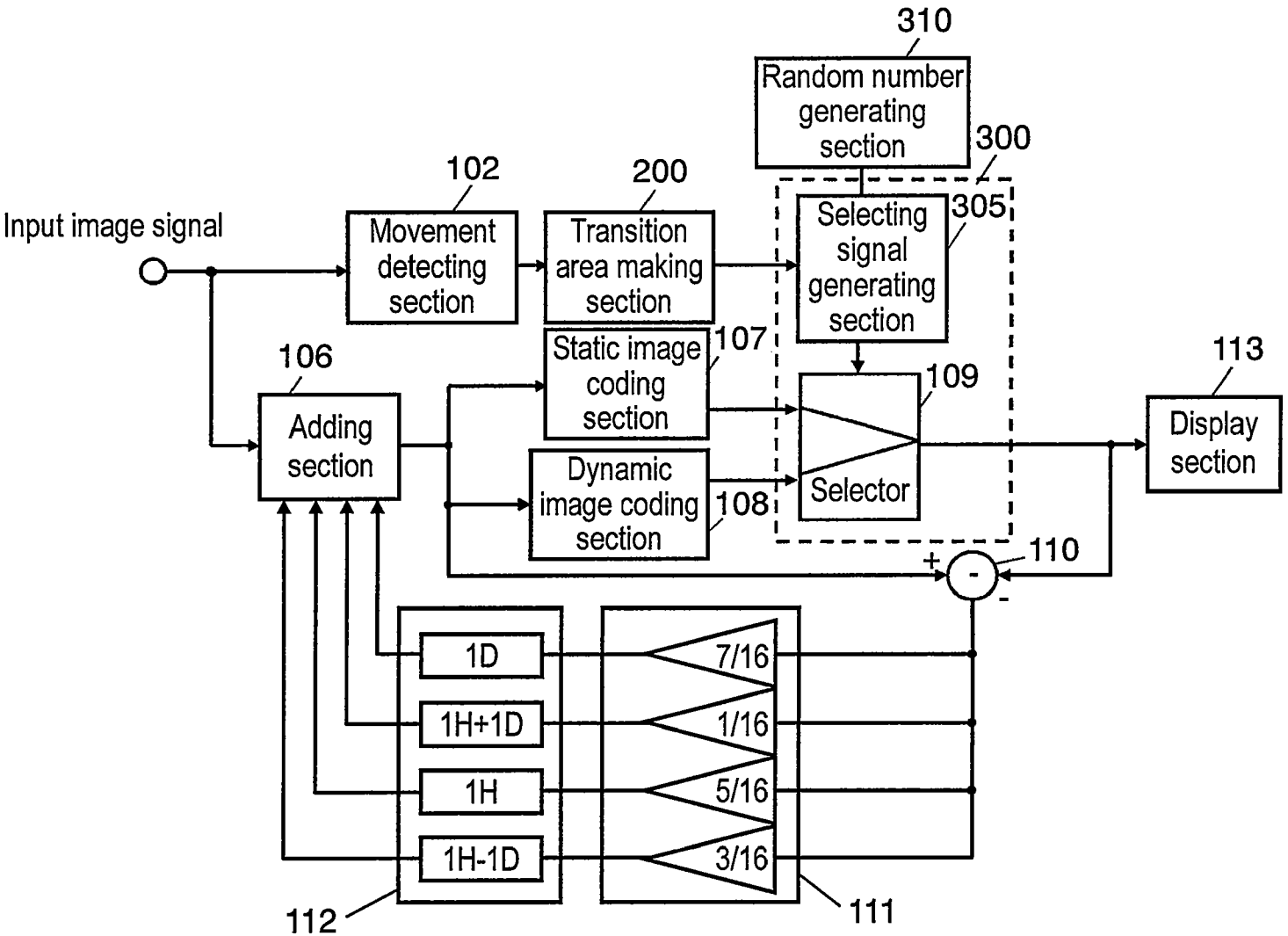
FIG. 3 is a circuit block diagram showing the construction of the image display device of embodiment mode 1 of the present invention.

FIG. 3 is a circuit block diagram showing the construction of the image display device in embodiment mode 1 of the present invention. The image display device has movement detecting section 102 for detecting the dynamic image area from an input image signal, and also has adding section 106 for adding an error diffused from a circumferential pixel to the input signal. The image display device also has static image coding section 107 for performing coding with respect to a pixel of the static image area with respect to the image signal provided by adding the error, and also has dynamic image coding section 108 for performing coding with respect to a pixel of the dynamic image area with respect to the image signal provided by adding the error. The image display device also has subtracting section 110 for calculating an error between an input image and an output image, and also has multiplying section 111 for performing predetermined weighting with respect to the error. The image display device also has delay section 112 for adjusting timing to diffuse the error to a predetermined pixel, and also has display section 113 for displaying the image signal.

In addition, the image display device of embodiment mode 1 of the present invention also has transition area making section 200 for arranging the transition area between the dynamic image area and the static image area, and also has random number generating section 310 for generating a random number. The image display device further has selecting section 300 for selecting one of an output of static image coding section 107 and an output of dynamic image coding section 108 on the basis of the random number generated in random number generating section 310 and a signal showing the transition area obtained from transition area making section 200. Selecting section 300 has selecting signal generating section 305 and selector 109. Selector 109 selects one of the output of static image coding section 107 and the output of dynamic image coding section 108 on the basis of a selecting signal outputted from selecting signal generating section 305. Selecting signal generating section 305 selects the output of dynamic image coding section 108 in the dynamic image area, and selects the output of static image coding section 107 in the static image area. Further, selecting signal generating section 305 generates the selecting signal in which probability for selecting a signal from dynamic image coding section 108 becomes high in the transition area near the dynamic image area, and probability for selecting a signal from static image coding section 107 becomes high in the transition area near the static image area.

Figure 4:
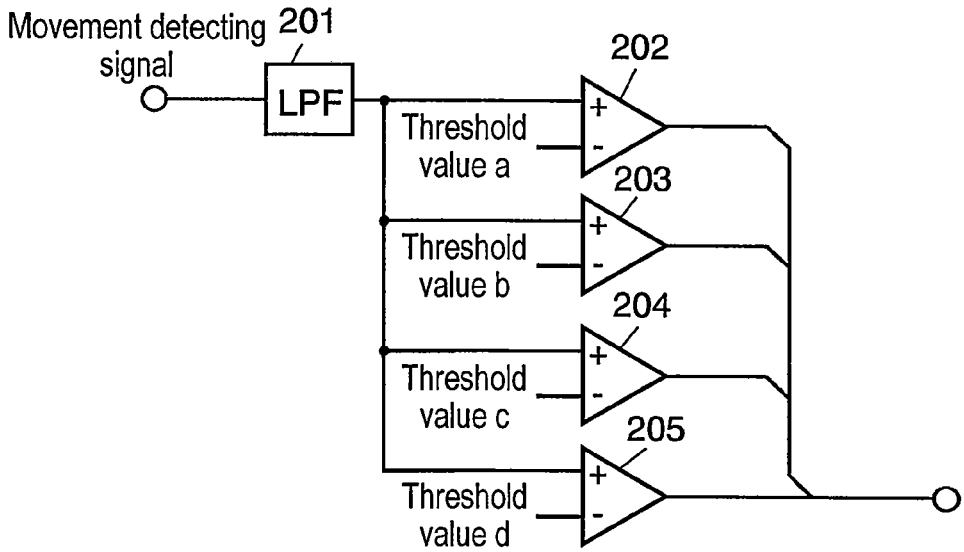
FIG. 4 is a circuit block diagram showing the construction of a transition area making section of the image display device of embodiment mode 1 of the present invention.
Figure 5A:
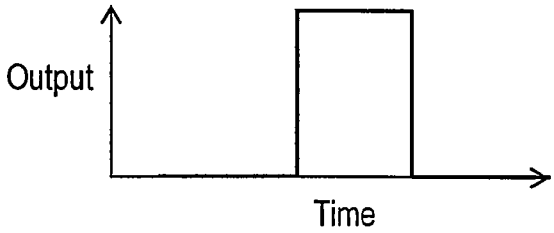
FIG. 5A is a view showing a movement detecting signal for explaining the operation of the transition area making section of the image display device of embodiment mode 1 of the present invention.
Figure 5B:
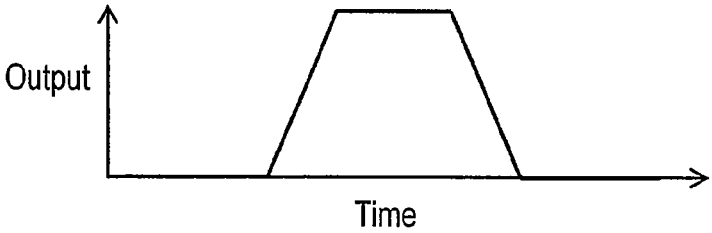
FIG. 5B is a view showing a signal after low-pass filter processing for explaining the operation of the transition area making section of the image display device of embodiment mode 1 of the present invention.
Figure 5C:
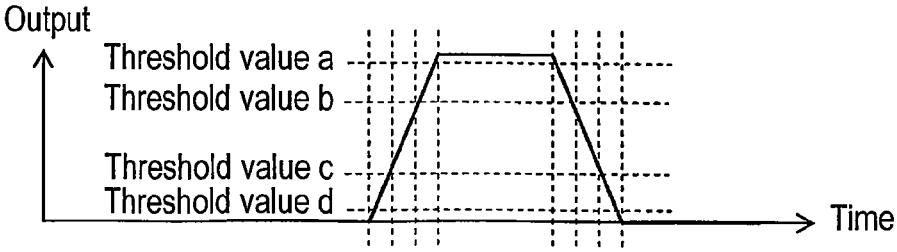
FIG. 5C is a view showing comparison of the signal after the low-pass filter processing for explaining the operation of the transition area making section of the image display device of embodiment mode 1 of the present invention, and each threshold value.

FIG. 4 is a circuit block diagram showing the construction of transition area making section 200. FIGS. 5A, 5B and 5C are views for explaining the operation of transition area making section 200. Transition area making section 200 has LPF circuit 201 for performing low-pass filter (hereinafter abbreviated as "LPF") processing with respect to a movement detecting signal detected by movement detecting section 102, and also has four comparators 202, 203, 204, 205 for comparing a signal after the LPF processing and a predetermined threshold value. Here, when the threshold values of comparators 202, 203, 204, 205 are respectively set to threshold values a, b, c, d, the relation of threshold value a>threshold value b>threshold value c>threshold value d is satisfied. For example, when the movement detecting signal is set to a signal shown in FIG. 5A, the signal after the LPF processing is provided as shown in FIG. 5B. The signal after the LPF processing is compared with each threshold value by comparators 202, 203, 204, 205. At this time, if the signal after the LPF processing is greater than threshold value a as shown in FIG. 5C, it is the dynamic image area. If this signal is threshold value a or less and is greater than threshold value b, it is the transition area near the dynamic image area. If this signal is threshold value b or less and is greater than threshold value c, it is the transition area near the middle. If this signal is threshold value c or less and is greater than threshold value d, it is the transition area near the static image area. If this signal is threshold value d or less, it is the static image area. In the following description, a binary number is allocated to make an explanation such that the output of comparator 202 is set to "1" when the signal after the LPF processing is threshold value a or more, and is set to "0" when this signal is smaller than threshold value a. The binary number is also similarly allocated with respect to the outputs of other comparators 203, 204, 205. The binary number of four bits is constructed by arranging the binary numbers of the respective outputs of comparators 202, 203, 204, 205 in this order such that the output of comparator 202 becomes MSB and the output of comparator 205 becomes LSB. If the signal of these four bits shows "15 (decimal number)", it is set to the dynamic image area. If the signal of these four bits shows "7 (decimal number)", it is set to the transition area near the dynamic image area. If the signal of these four bits shows "3", it is set to the transition area near the middle. If the signal of these four bits shows "1 (decimal number)", it is set to the transition area near the static image area. If the signal of these four bits shows "0 (decimal number)", it is set to the static image area.

Selecting signal generating section 305 is constructed by a conversion table for inputting the random number of two bits generated in random number generating section 310 and the signal of four bits showing the transition area and made in transition area making section 200, and outputting a selecting signal. FIG. 6 shows one example of the conversion table. As shown in FIG. 6, in the conversion table, "1" is always outputted in the dynamic image area, and "1" is outputted in the transition area near the dynamic image area in a ratio of three pixels to four pixels. "1" is outputted near the middle of the transition area in a ratio of two pixels to four pixels. In the transition area near the static image area, "1" is outputted in a ratio of one pixel to four pixels. In the static image area, "0" is always outputted. If the selecting signal shows "1", selector 109 selects an output signal from dynamic image coding section 108. If the selecting signal shows "0", selector 109 selects an output signal from static image coding section 107.

The coding method is gradually switched between the dynamic image area and the static image area by the above construction. Therefore, the switching shock can be restrained and image display quality can be improved.

In embodiment mode 1, the coding method in the transition area has been explained such that this coding method is changed at three stages. However, the present invention is not limited to this case, but the switching shock can be restrained by arranging the transition area for smoothly connecting the dynamic image area and the static image area and mixedly arranging a different coding method within the transition area.

Further, even when the coding method is changed at three stages, the mixing ratio of the coding method in each transition area is not limited to 3:1, 2:2 and 1:3, but may be also set to 4:1, 1:1 and 1:4, etc.

Further, in embodiment mode 1, the method for limiting gradation and complementing reduced gradation by using the error diffusing processing has been explained as the coding method of the dynamic image area. However, the present invention is not limited to this method, but gradation may be also complemented by dither processing and may be also complemented by jointly using the error diffusing processing and the dither processing.

Further, in embodiment mode 1, after the LPF processing is performed with respect to the movement detecting signal, the transition area is made by using the comparator. However, the present invention is not limited to this construction, but the transition area can be also made by repeatedly performing thick line formation processing with respect to the movement detecting signal.

Embodiment Mode 2

Figure 7:
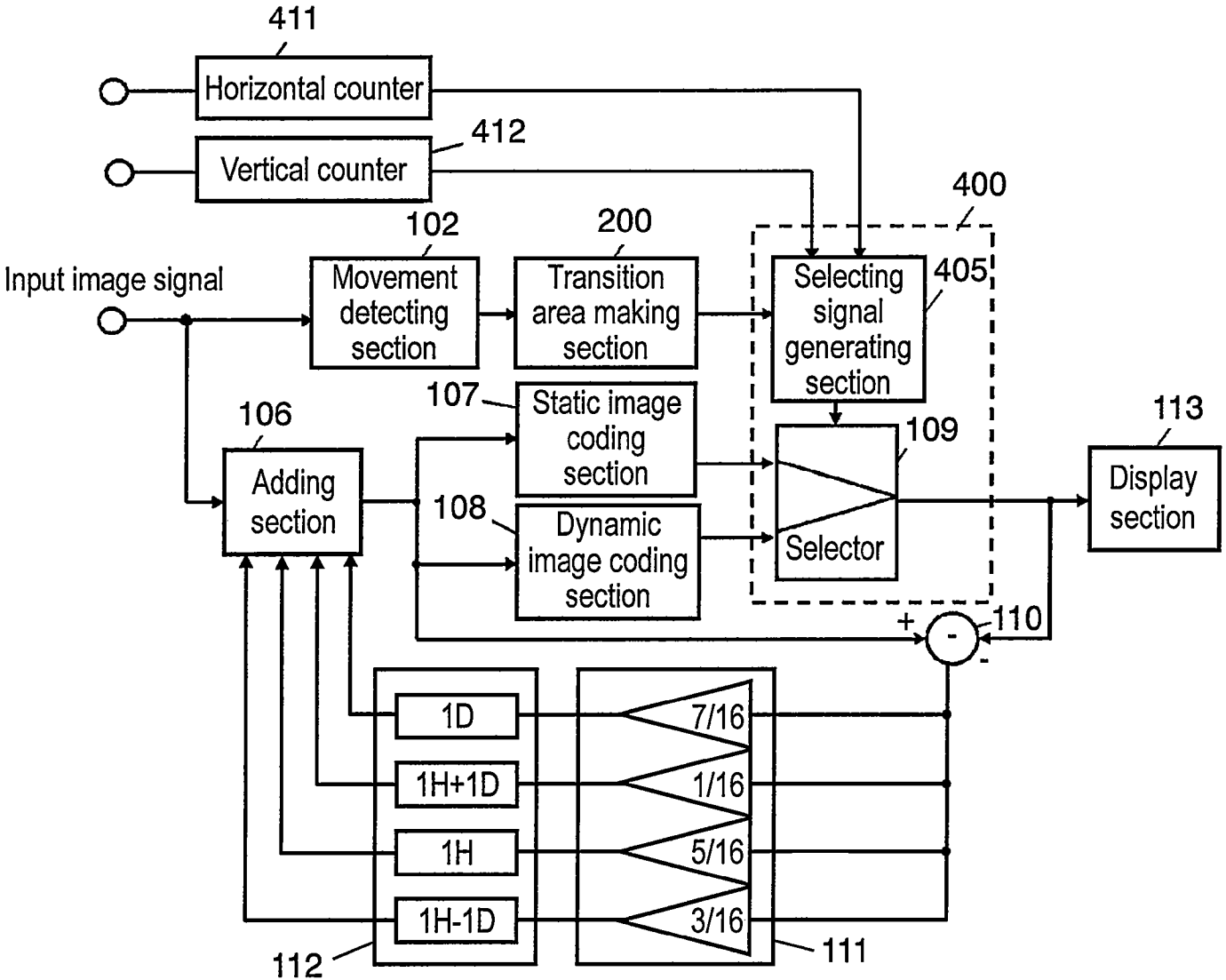
FIG. 7 is a circuit block diagram showing the construction of an image display device in embodiment mode 2 of the present invention.

FIG. 7 is a circuit block diagram showing the construction of an image display device in accordance with embodiment mode 2 of the present invention. In FIG. 7, the same reference numerals as FIG. 3 are used with respect to the same constructional elements as FIG. 3, and their explanations are omitted.

In embodiment mode 2, horizontal counter 411, vertical counter 412 and selecting section 400 are arranged instead of random number generating section 310 of FIG. 3. Horizontal counter 411 performs a counting-up operation by a clock synchronized with an input image signal. Vertical counter 412 performs a counting-up operation by a clock synchronized with a horizontal synchronous signal. Selecting section 400 generates a selecting signal for selecting one of an output signal from static image coding section 107 and an output signal from dynamic image coding section 108. Selecting section 400 generates the selecting signal on the basis of a horizontal LSB signal as LSB of an output of horizontal counter 411, a vertical LSB signal as LSB of an output of vertical counter 412, and a signal of four bits outputted from transition area making section 200.

FIG. 8A is a chart for explaining the operation of selecting signal generating section 405 of the image display device in embodiment mode 2 of the present invention, and setting a dither element from the horizontal LSB signal and the vertical LSB signal. FIG. 8B is a chart for setting the selecting signal from the dither element of FIG. 8A and an output value of transition area making section 200. Square shapes marked as "0", "1", "2", "3" of FIG. 8A show respective pixels of the image display device. The input image signal is sequentially inputted and is displayed correspondingly from a left-hand pixel to a right-hand pixel and from an upper pixel to a lower pixel. The horizontal LSB signal of horizontal counter 411 sequentially has the values of 0, 1, 0, 1, --- from a pixel of the left-hand end in synchronization with the input of the image signal. Further, the vertical LSB signal of vertical counter 412 sequentially has the values of 0, 1, 0, 1, --- from a pixel of the upper end. These values are calculated by using the following formula:

$$2\times(\text{horizontal LSB signal XOR vertical LSB signal})+(\text{horizontal LSB signal})$$

so that the value (hereinafter called a "dither element") of one of values 0 to 3 is set to each pixel in accordance with a position on the image display device.

The value written in each pixel of FIG. 8A is the dither element. Thus, the dither element is a value determined by only the position on the display device of each pixel. Selecting signal generating section 405 generates the selecting signal as shown in FIG. 8B from this dither element and the four-bit signal outputted from transition area making section 200.

Figure 9:
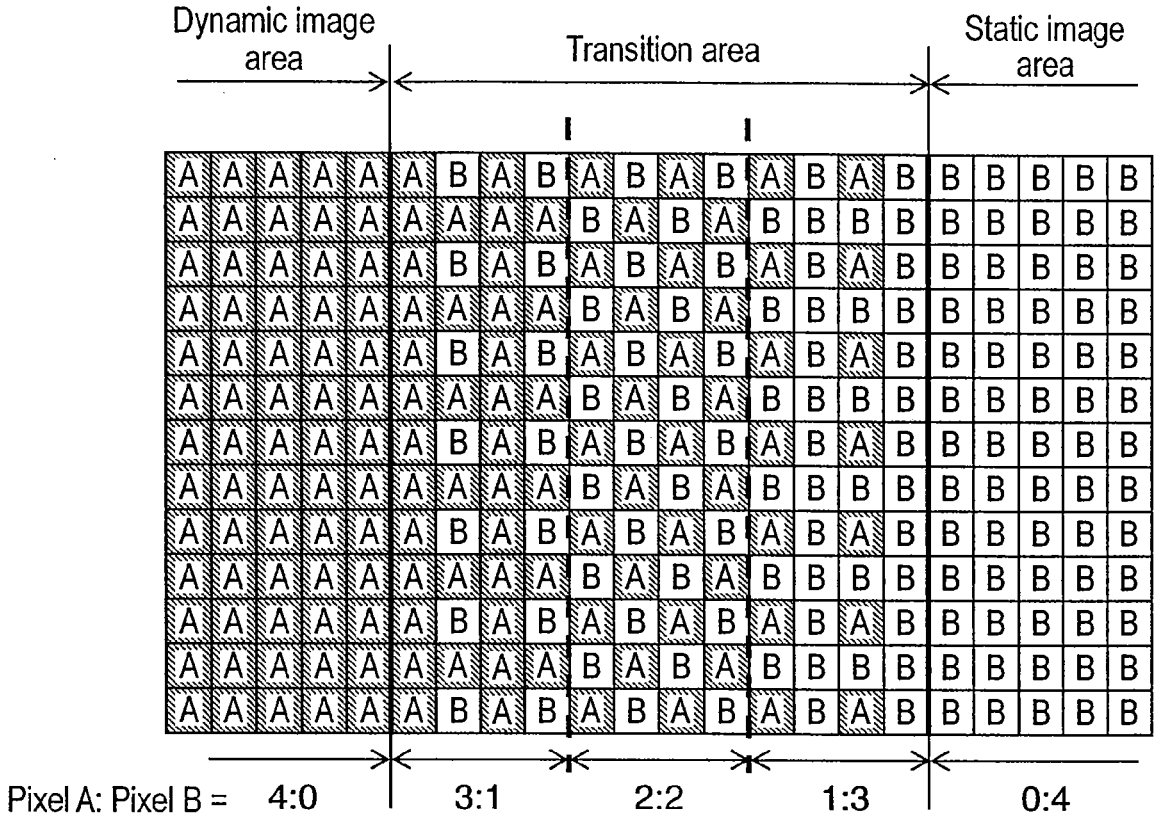
FIG. 9 is an image view showing a situation in which pixels A and B mixedly exist in a transition area in the image display device in embodiment mode 2 of the present invention.
Figure 12:
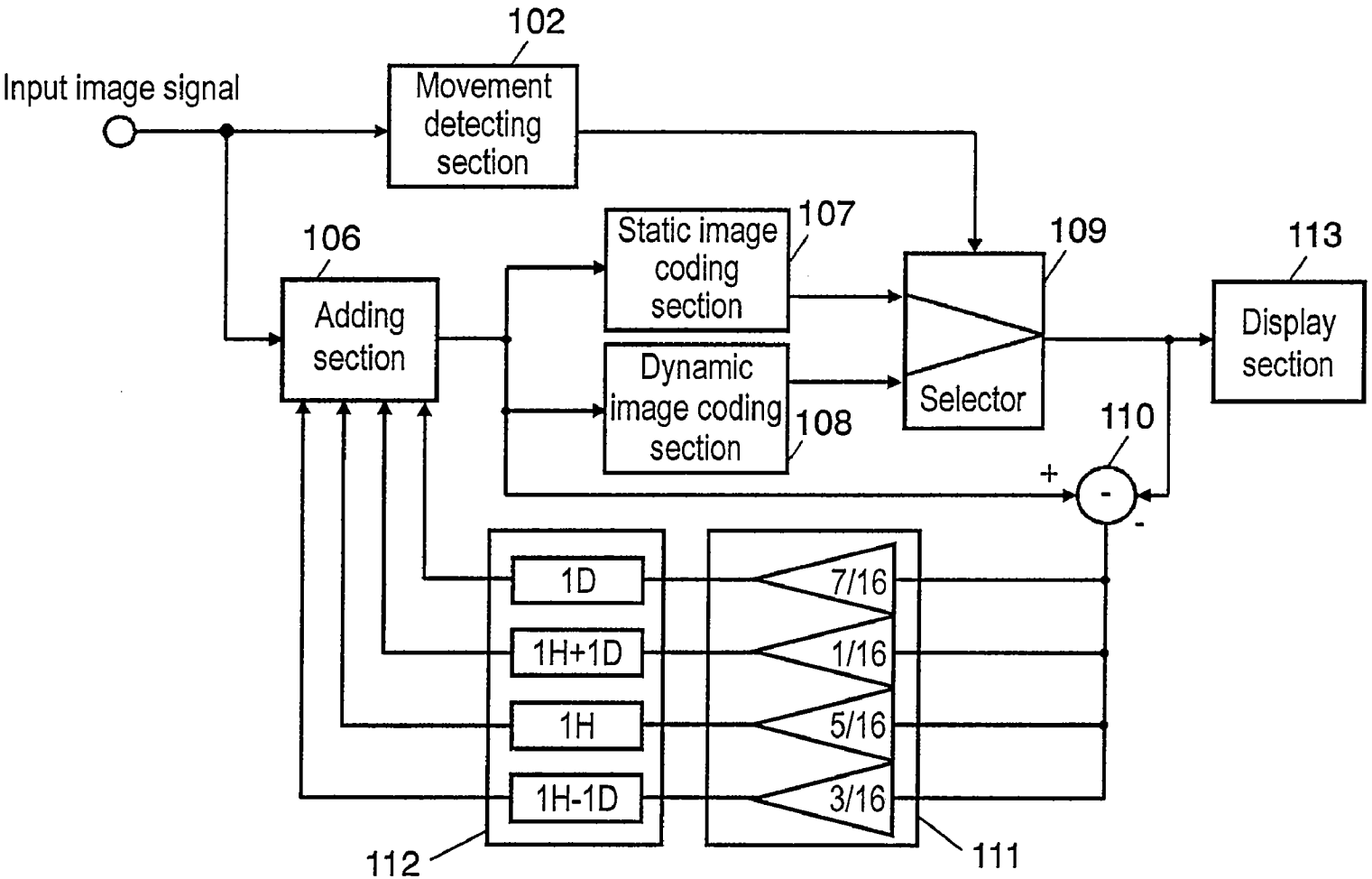
FIG. 12 PRIOR ART
FIG. 12 is a circuit block diagram showing the construction of the conventional image display device.

FIG. 9 is an image view showing a situation in which pixels A and B mixedly exist in the transition area. Pixels A and B mixedly exist in the transition area by using the selecting signal generated as mentioned above. Similar to embodiment mode 1, pixels A and B mixedly exist in a ratio of 3:1 in the transition area near the dynamic image area, and mixedly exist in a ratio of 2:2 in a central portion of the transition area, and mixedly exist in a ratio of 1:3 in the transition area near the static image area.

Since the coding method is gradually switched between the dynamic image area and the static image area by the above construction, the switching shock can be restrained and display quality of an image can be improved.

In embodiment mode 2, the dither element is set to four values from 0 to 3, but the present invention is not limited to this case. The dither element can be changed in accordance with a stage number for changing the mixedly existing ratio in the transition area.

INDUSTRIAL APPLICABILITY

In accordance with the image display method and the image display device of the present invention, the dynamic image false contour is restrained and the dynamic image area and the static image area are smoothly connected and the switching shock is restrained and image display quality can be improved. Therefore, it is useful in an image display method and an image display device in which one field is constructed by plural subfields weighted in brightness, and coding for controlling light emission or light non-emission of a pixel of each subfield is performed, and gradation is displayed, etc.

The invention claimed is:

1. An image display method in which one field of an image is constructed by plural subfields weighted in brightness, and performing dynamic image coding and static image coding for controlling light emission and light non-emission of a pixel every each subfield is performed to display gradation, the dynamic image coding and the static image coding are different, the method comprising the steps of:

detecting movement in the image; and identifying at least three separate pixel areas within the image, the three separate pixel areas including a transition area of pixels positioned between a dynamic image area of pixels and a static image area of pixels;

dividing the transition area into a plurality of smaller transition areas, each of the smaller transition areas having a width of two or more pixels along a boundary of the dynamic image area and the static image area;

determining, for each of the smaller transition areas, a respective first probability of selecting dynamic image coding and a respective second probability of selecting static image coding, wherein the respective first probability and second probability of each of the plurality of smaller transition areas are different than the respective first probability and second probability of the other smaller transition areas; and coding the pixels in each of the smaller transition areas by selecting the dynamic image coding based on the respective first probability and selecting the static image coding based on the respective second probability, the respective first and second probabilities defined for each of the smaller transition areas based on a distance from the pixels in each of the smaller transition areas to a) pixels in the dynamic image area and b) pixels in the static image area.

2. The image display method of claim 1, including the steps of:

defining the first probability to be high in the transition area near the dynamic image area, and defining the second probability to be high in the transition area near the static image area, such that the pixels in the transition area are spatially mixed according to the probabilities.

3. The image display method of claim 1, including the steps of:

defining the first probability to be high in the pixel of the transition area near the dynamic image area, and the second probability to become high in the pixel of the transition area near the static image area, such that the pixels in the transition area are time-wise mixed according to the probabilities.

4. An image display device in which one field in an image is constructed by plural subfields weighted in brightness, and dynamic image coding and static image coding are performed for controlling light emission and light non-emission of a pixel every each subfield is performed to display gradation, the dynamic image coding and the static image coding are different, the image display device comprising:

a movement detecting section for detecting movement in the image;

a transition area making section for making three separate pixel areas within the image, by positioning a transition area of pixels between a dynamic image area of pixels and a static image area of pixels, and dividing the transition area into a plurality of smaller transition areas, each of the smaller transition areas having a width of two or more pixels along a boundary of the dynamic image area and the static image area;

a dynamic image coding section for performing the dynamic image coding;

a static image coding section for performing the static image coding; and a selecting section for determining, for each of the smaller transition areas, a respective first probability of selecting dynamic image coding and a respective second probability of selecting static image coding, and coding the pixels in each of the smaller transition areas by selecting the dynamic image coding based on the respective first probability and selecting the static image coding based on the respective second probability, the respective first and second probabilities defined for each of the smaller transition areas based on a distance from the pixels in each of the smaller transition areas to a) pixels in the dynamic image area, and b) pixels in the static image area, wherein the respective first probability and second probability of each of the plurality of smaller transition areas are different than the respective first probability and second probability of the other smaller transition areas.

5. The image display device of claim 4, wherein a random number generating section for generating a random number is further arranged, and the selecting section irregularly selects one of the output of the dynamic image coding section and the output of the static image coding section in the transition area on the basis of the random number generated in the random number generating section.

6. The image display device of claim 4, wherein a counter for counting a clock synchronized with an input image signal is further arranged, and the selecting section regularly selects one of the output of the dynamic image coding section and the output of the static image coding section in the transition area on the basis of an output of the counter.

7. An image display method in which one field of an image is constructed by plural subfields weighted in brightness, and coding for controlling light emission and light non-emission of a pixel every each subfield is performed to display gradation, wherein dynamic image coding is performed on pixels in a dynamic image area and static image coding is performed on pixels in a static image area, the method comprising the steps of:

detecting the dynamic image area from an input image signal;

identifying at least three separate pixel areas within the image by positioning a transition area of pixels which is divided into a plurality of smaller transition areas between the dynamic image area and the static image area by comparing a movement detecting signal based on the detecting of the dynamic image area and a plurality of threshold values, each of the smaller transition areas having a width of two or more pixels along a boundary of the dynamic image area and the static image area;

determining, for each of the smaller transition areas, a respective first probability of selecting dynamic image coding and a respective second probability of selecting static image coding, wherein the respective first probability and second probability of each of the plurality of smaller transition areas are different than the respective first probability and second probability of the other smaller transition areas;

selecting the dynamic image coding in the dynamic image area;

selecting the static image coding in the static image area; and selecting one of the dynamic image coding and the static image coding within the smaller transition areas;

wherein, defining the first probability to be high in one of the transition areas near the dynamic image area and defining the second probability to be high in one of the transition areas near the static image area.

8. An image display device in which one field of an image is constructed by plural subfields weighted in brightness, and coding for controlling light emission and light non-emission of a pixel every each subfield is performed to display gradation, and having a dynamic image coding section for performing dynamic image coding on pixels in the dynamic image area and a static image coding section for performing static image coding on pixels in the static image area;

the image display device comprising;

a movement detecting section for detecting the dynamic image area from an input image signal;

a transition area making section for identifying at least three separate pixel areas in the image by positioning a transition area of pixels divided into a plurality of smaller transition areas of pixels between the dynamic image area and the static image area by comparing a movement detecting signal outputted from the movement detecting section and a plurality of threshold values, each of the smaller transition areas having a width of two or more pixels along a boundary of the dynamic image area and the static image area;

a selecting section for determining, for each of the smaller transition areas, a respective first probability of selecting dynamic image coding and a respective second probability of selecting static image coding, and selecting one of an output of the dynamic image coding section and an output of the static image coding section within the transition areas made by the transition area making section;

wherein, the respective first probability and second probability of each of the plurality of smaller transition areas are different than the respective first probability and second probability of the other smaller transition areas, the selecting section selects the output of the dynamic image coding section in the dynamic image area and selects the output of the static image coding section in the static image area, and the selecting section defines the first probability to be high in one of the transition areas near the dynamic image area and defines the second probability to be high in one of the transition areas near the static image area.

* * * * *